United States Patent [19]

Berg et al.

[11] Patent Number: 4,717,813

[45] Date of Patent: Jan. 5, 1988

[54] MULTIPASSAGE, MULTIPHASE ELECTRICAL HEATER

[75] Inventors: Peter G. Berg, Attleboro Falls; Leo Marcoux, Rehoboth; Bernard M. Kulwicki, Foxboro, all of Mass.

[73] Assignee: Texas Instruments Incorporated, Dallas, Tex.

[21] Appl. No.: 852,478

[22] Filed: Apr. 16, 1986

[51] Int. Cl.[4] ..... H01C 7/02; H05B 3/08

[52] U.S. Cl. ..... 219/541; 219/374; 219/375; 219/381; 219/552; 219/553; 219/505; 338/22 R; 338/25

[58] Field of Search ..... 219/374, 375, 381, 382, 219/504, 505, 541, 552, 553; 338/22 R, 25; 427/88, 97

[56] References Cited

U.S. PATENT DOCUMENTS 4,264,888 4/1981 Berg ..... 338/25

4,570,046 2/1986 Melanson et al. ..... 219/68

*Primary Examiner*—E. A. Goldberg

*Assistant Examiner*—Gerald E. Preston

*Attorney, Agent, or Firm*—John A. Haug; James P. McAndrews; Melvin Sharp

[57] ABSTRACT

A resistor particularly useful as a multiphase, self-regulating fluid heater has passages extending through a body of ceramic resistance material of positive temperature coefficient of resistivity (PTC) for heating fluid adapted to pass therethrough. Several embodiments are provided with electrically conductive coatings formed on inner walls of the passages with the passage walls defining thin webs of the resistance material having uniform thickness from end to end. The passages are arranged in a plurality of sets with the conductive coating on the walls of the passages of each set interconnected and adapted for electrical connection with a respective electrical phase. The passages of the sets are alternated relative to one another throughout the body with a passage of one set immediately adjacent only to passages of other sets. The passages are configured in different embodiments including hexagonal, triangular and rectangular as seen in plan view showing one end of the body. Other embodiments have electrically conductive coatings formed on opposite end faces of the body. In one embodiment the coating on one face serves as a common connection while the coating on the other face is separated into portions electrically isolated form one another with each portion adapted to be electrically connected to a respective phase. The latter embodiment is particularly suited for a wye electrical connection while the former embodiments are well suited for delta connections. In another embodiment, particularly suited for a delta connection, the conductive portions on one face are angularly disposed a selected amount relative to the conductive portions on the other face.

16 Claims, 15 Drawing Figures

MULTIPASSAGE, MULTIPHASE ELECTRICAL HEATER

BACKGROUND OF THE INVENTION

This invention relates generally to electrical resistance bodies used as fluid heaters having a plurality of passages extending therethrough for reception of fluid to be heated by the bodies and more particularly to such bodies which are operable with multiphase electrical power.

Resistors having passages extending through a body of ceramic resistance material of positive temperature coefficient of resistivity have been proposed for use as fluid heaters. Such heaters are safe and self-regulating and are adapted to generate high volume outputs of heated air for a hair dryer or the like or to safely and efficiently heat the air-fuel mixture being supplied to an automobile engine to assure early volatilization of the fuel before the mixture is furnished to the engine. In one such device, coatings are formed on the inner walls of the resistor body passages and are interconnected so that electrical current can be directed through the thin webs of resistance material between coatings of opposite polarity in adjacent body passages, thereby to generate a large amount of heat for efficient transfer to a fluid directed through the passages. A device of this type is shown and described in U.S. Pat. No. 4,264,888.

Another use for this type of heater is shown and described in copending application Ser. No. 852,484, now U.S. Pat. No. 4,678,982, assigned to the assignee of the instant invention and filed on even date herewith. In that application a heater particularly adapted for use in an automotive vehicle is energized by a three phase power supply derived from the alternator of the vehicle. One of the uses of the heater is as a supplemental air heater wherein the heater is disposed in the air stream generated by the main heater fan downstream of the main heater. The supplemental heater is used, when desired, to add incremental heat to the passenger compartment to greatly reduce warm up time for creating an environment comfortable for passengers, or in vehicles having marginal heat sources for adding sufficient heat to the passenger compartment to achieve a selected steady state temperature on particularly cold days. The heater is comprises of a plurality of discrete heater bodies made in accordance with U.S. Pat. No. 4,264,888 mounted in a frame which is adapted to be placed across an air duct intercepting air carried from the main heater. Each of the bodies is of a ceramic material or the like of positive temperature coefficient of resistivity (PTC) having a large member of passages extending through the body in side-by-side parallel relationship to each other between opposite ends of the body. The passage walls define the webs of resistance material between adjacent passages in the body and the walls are of uniform thickness from end to end extending to the generally flat ends of the resistor body. Electrically conductive metal coatings are adhered to the inner walls of the body passages of the resistor body. The passages are divided into two groups with the passages of one group alternated among the passages of the other group and electrically conducting interconnecting means are provided to interconnect the passages of each group together.

The bodies are arranged in the frame and electrical interconnecting means are provided so that each phase of the current is directed to its own body or bodies with current directed through the thin webs of resistance material located between adjacent body passages in each respective body.

The particular resistance of the web is a function of heat dissipation of the webs which in turn is a function of the air flow passing through the passages. Due to a number of factors, air flow through a duct tends to be somewhat uneven across its cross section, however, to achieve an efficient, long lived system it is important to have an even resistive load among the phases to avoid adversely affecting the alternator. The heater assembly disclosed in the copending application obtains a balanced load by arranging the bodies into a plurality of rows of bodies connected to each phase and alternating the rows so that the bodies of each phase will be in several locations across the cross section of the duct. The bodies within each phase are electrically connected in parallel relation.

While the above described arrangement can be effective, the ability to achieve a satisfactory resistive balance requires a certain amount of custom work in providing proper row alternations for air streams of different ducts. Further, if the air flow profile changes, for example with different fan speeds, then some imbalance may result. In addition, it is desirable to reduce the number of component parts of the assembly in order to minimize manufacturing costs.

It is therefor an object of the present invention to provide a multipassage, multiphase, self-regulating fluid heater which is simple yet reliable and which results in a balanced resistive load for power generation regardless of variations in the flow of the fluid stream which pass through the passages.

SUMMARY OF THE INVENTION

Briefly, a heater made in accordance with the invention comprises a body of ceramic material or the like of positive temperature coefficient of resistivity (PTC) having a large number of passages extending through the body in side-by-side parallel relation to each other between opposite ends of the body. In a first group of embodiments particularly well suited for connection in a delta configuration, the passage walls define thin webs of the resistance material between adjacent passages in the body with the walls of the passages being of uniform thickness from end to end extending out to the generally flat ends of the resistor body. Electrically conductive metal coatings are adhered to the inner walls of the body passages of the resistor body in a conventional manner. The passages are arranged in a plurality of sets with the conductive coating on the walls of the passages of each set interconnected and adapted for electrical connection with a respective electrical phase. The passages of the sets are alternated relative to one another throughout the body with a passage of one set immediately adjacent only passages of other sets. The passages are configured in different embodiments as hexagonal, triangular and rectangular as seen in plan view showing one end of the body. In a three phase heater the passages of two phases are interconnected on one end of the body while the passages of the third phase are interconnected on the opposite end of the body.

Another embodiment particularly suited for connection in a wye configuration has electrically conductive coatings adhered to opposite end faces of the body. The coating on one face serves as a common connection while the coating on the other face is separated into portions electrically isolated from one another with each portion adapted to be electrically connected to a respective phase.

Another embodiment particularly suited for connection in a delta configuration has electrically conductive portions on one face angularly disposed a selected amount relative to electrically conductive portions on the opposite face.

DESCRIPTION OF THE DRAWINGS

Other objects, advantages and details of the resistor device provided by this invention appear in the following detailed description of preferred embodiments of the invention, the detailed description referring to the drawings in which.

DESCRIPTION OF THE PREFERRED EMBODIMENTS

Figure 2:
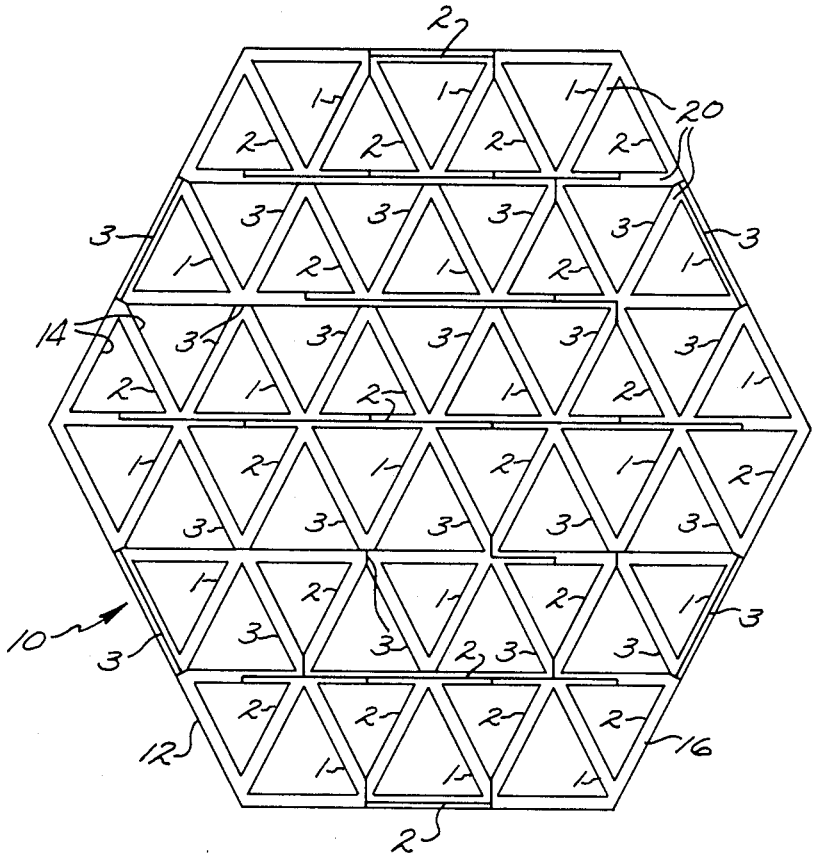
FIG. 2 is an enlarged top plan view of a three phase, multipassage heater body with triangular configured passages made in accordance with a first embodiment of the invention.
Figure 3:
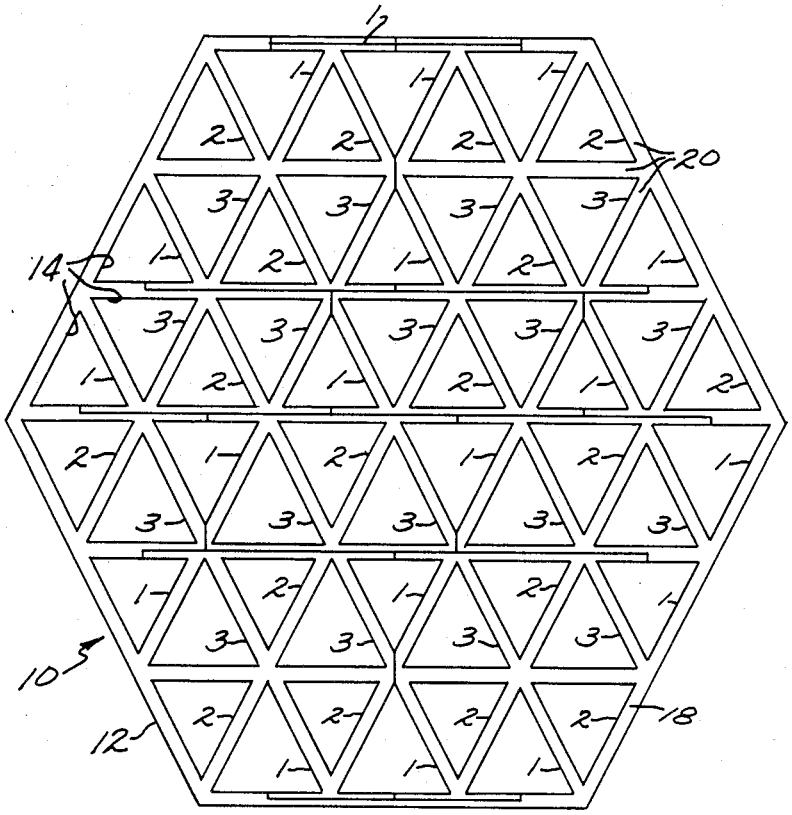
FIG. 3 is a bottom plan view of the FIG. 2 heater body.

Referring to the drawings, numeral 10 in FIGS. 2 and 3 indicates the novel and improved resistor device which is particularly adapted for use as a fluid heater according to a first embodiment of the invention. As shown, the device includes a body 12 of a ceramic material or the like of positive temperature coefficient of resistivity. Preferably the body comprises a ceramic material such as lanthanum doped barium titanate or the like and preferably the material is adapted to display a sharp, anomolous increase in resistivity when the body is heated to a particular temperature. The body has a plurality of passages 14 extending in a pattern between opposite ends 16 and 18 or the body. The body has a large number of passages in multiples of the number of phases to which it is to be connected. As depicted in FIGS. 2 and 3, heater device 10 is a three phase heater and passages 14 each has a triangular configuration when seen in plan view as shown in the figures. Web 20 of resistance material separate the passages from each other.

In accordance with the invention, webs or passage walls 20 are of substantially uniform thickness from end to end extending to the generally flat end faces 16 and 18 of the resistor body. That is, the thickness of each of webs 20 is substantially the same at each end of faces 16 and 18 as it is in the central part of the resistor body thereby providing the same amount of resistance material between adjacent passages throughout the body. Typically, for example, the resistor body is about 0.25 inches long from end 16 to end 18 with the webs between adjacent passages about 0.020 inches thick to provide a selected low resistance at room temperature. If desired, the walls along the outer periphery of body 12 may be somewhat thicker than web 20 between adjacent passages in the body for improving shock resistance or the physical strength of the resistor body for given resistivity properties of the body. The outer peripheral shape of the body is preferably hexagonal to most conveniently accommodate the triangular shaped passages. Typically body 12 is formed of a lanthanum-doped barium titanate having the empirical formula $Ba_{0.968}Pb_{0.030}La_{0.002}TiO_3$. Such a resistor material has a room temperature resistivity of about 360 ohm-centimeters, a Curie temperature of about 140° C. and displays a sharp, anomolous increase in resistivity to about $10^5$ ohm-centimeters when heated above its anomaly temperature.

In accordance with a feature of the invention, the inner walls of the resistor body passages 14 are covered with an adherent, electrically conductive coating on the resistor body 12. The coatings are electrically connected together in a plurality of sets 1, 2 and 3 by conductive traces on an end face of body 12. Thus, as seen schematically in FIG. 2, the passages of sets 2 and 3 are connected together by traces on face 16 while the passages of set 1 are connected together by traces on face 18 (FIG. 3). The passages within a set are alternated with the passages of the other sets throughout the body so that a passage of one set is immediately adjacent only to passages of other sets.

Figure 1:
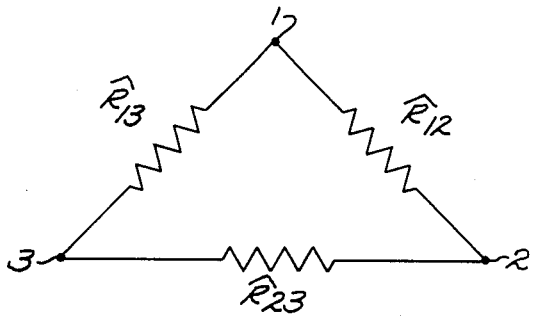
FIG. 1 is a schematic circuit diagram of the composite resistance of heaters of a first group of embodiments connected in a delta configuration.

It will be seen that variations in fluid flow of a fluid directed through the passages will be essentially the same for all the sets with the result that heat is dissipated equally among the sets and therefore the cumulative resistance for all the sets is essentially equal. As seen in FIG. 1, $\hat{R}_{13}$ is the cumulative or composite resistance of webs 20 between coatings 1 and 3, $\hat{R}_{12}$ between coatings 1 and 2 and $\hat{R}_{23}$ between coatings 2 and 3.

The coatings and traces are applied to the body in any conventional manner as by spraying, brush coating, dip coating, electroless plating or the like, with or without the use of temporary masks as may be desired within the scope of the invention.

Figure 4:
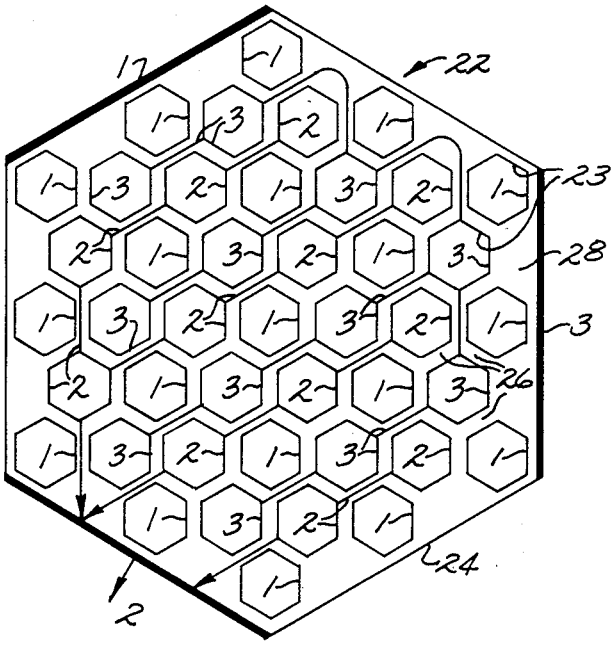
FIG. 4 is a top plan view of a three phase, multipassage heater body with hexagonal configured passages made in accordance with a second embodiment of the invention.
Figure 5:
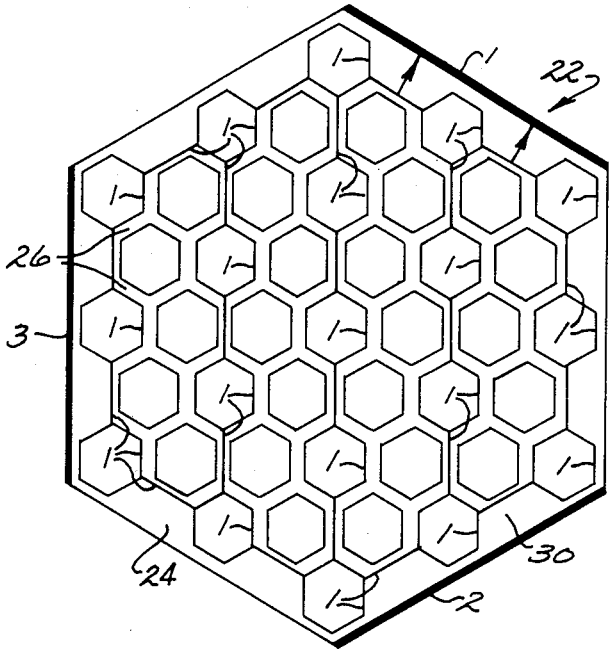
FIG. 5 is a bottom plan view of the FIG. 4 heater body.

With reference to FIGS. 4 and 5 a modified resistance heater device 22 is shown in which the parallel extending apertures 23 in body 24 are hexagonal in configuration as viewed in the figures. The passages are separated from one another by webs 26 analogous to webs 20 of FIGS. 2 and 3. The inner walls of the passages are coated with conductive material in the same manner as with body 12 and traces are applied to opposite end faces with traces connecting passages of sets 2 and 3 on end face 28 (FIG. 4) and traces connecting the passages of set 1 on end face 30 (FIG. 5).

The outer peripheral configuration of heating device 22 is shown to be hexagonal although that could be varied as long as the passages of the sets are properly grouped so that the composite resistance (webs 26) are equal and balanced. The hexagonal configuration provides a convenient way to electrically connect the heater to a three phase supply by having conductive layers of each set disposed on respective alternate external walls as noted by the heavy lines on the outer walls of body 24.

Other than noted above the construction and operation of heater device 22 is the same as heater device 10 of FIGS. 2 and 3.

Figure 6:
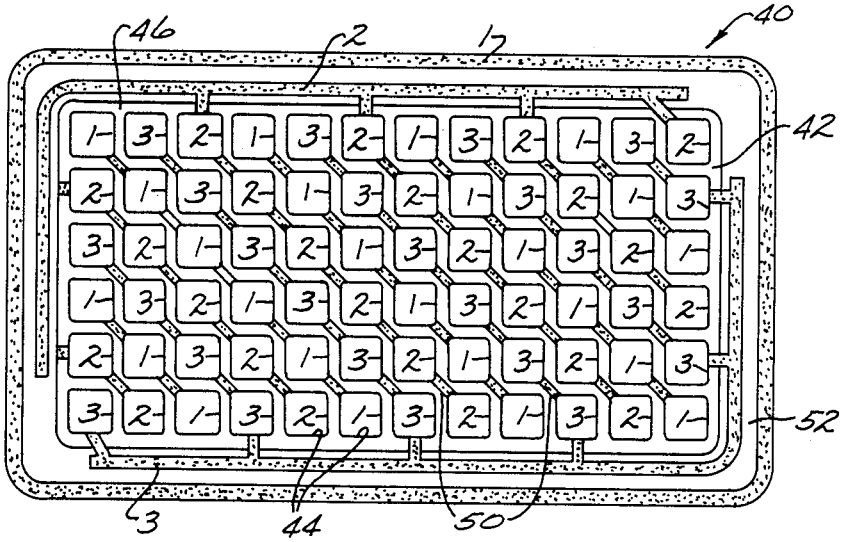
FIG. 6 is a top plan view of a three phase, multipassage heater body with rectangular configured passages made in accordance with a third embodiment but shown schematically with its side walls in the same plane as its top end to better illustrate the electrical interconnections for the three phases.
Figure 7:
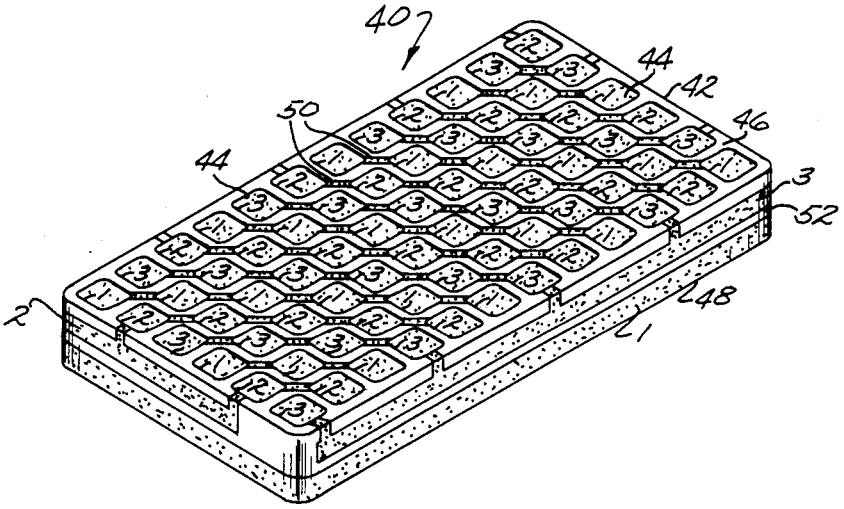
FIG. 7 is a perspective view of the FIG. 6 heater body.

With reference to FIGS. 6 and 7 a heater device 40 is shown to comprise a generally rectangular body 42 having generally rectangular shaped passages 44 but preferably having rounded corners extending parallely from one end 46 to an opposite end 48. This embodiment is similar to the previously mentioned embodiments regarding the conductive coating on the inner walls of passages 44 and the disposition of the passages of each set relative to the passages of the other sets so that the composite resistance of the webs between the passages of each set are equal. However the passages of each set are interconnected in a slightly different manner. As shown in U.S. Pat. No. 4,264,888, slits 50 extending slightly below the outer end surface of the body are formed between selected passages and a conductive coating is coated on the surfaces forming the slits so that, as seen in FIGS. 6 and 7, passages of sets 2 and 3 are interconnected via slits formed on end face 46 while passages of set 1 are connected by similar slits (not shown) on end face 48. Conductive traces 1, 2 and 3 are formed on the outer peripheral wall 52 as noted in FIGS. 6 and 7 (FIG. 6 shows the outer wall 52 shcematically in the same plane as end face 46 for purposes of illustration) for convenient electrical connection with contact springs (not shown) for connection with a three phase power supply.

The FIGS. 6, 7 embodiment is particularly adapted for placement in conventionally shaped automotive air heater ducts which typically are rectangular in configuration. It will be understood that a single discrete body 40 could be used in such a duct if it is desired to make the body large enough to occupy essentially the entire cross section of the duct or, if the duct is too large, then a plurality of bodies 40 could be mounted in a frame and connected electrically in parallel with one another. In either case an essentially evenly balanced resistive loading will be achieved because of distribution of the passages of all the sets throughout the cross section of the duct.

Figure 8:
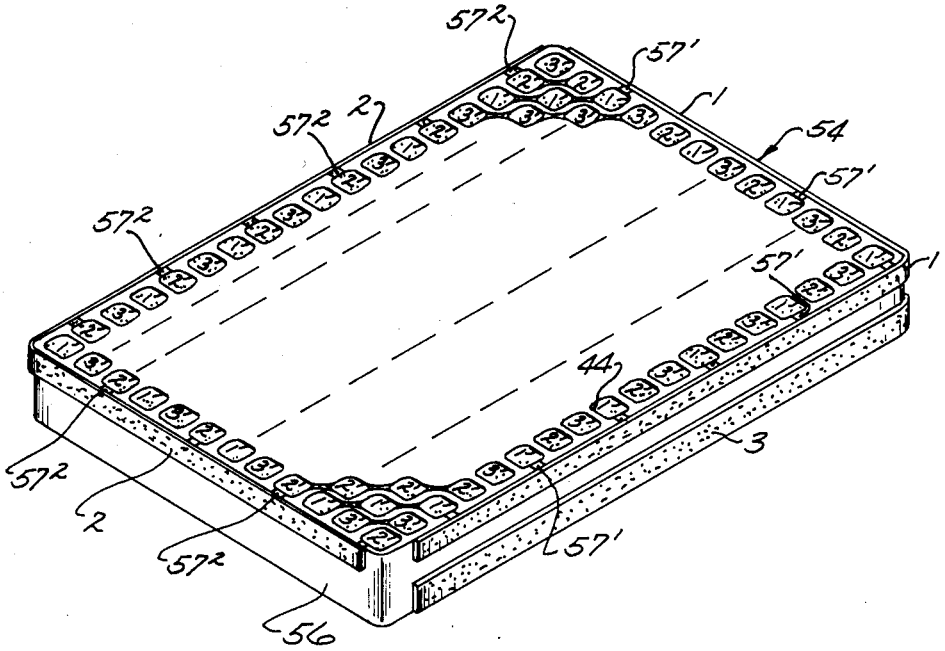
FIG. 8 is a perspective view similar to FIG. 7 of a modification of the FIG. 6, 7 embodiment.
Figure 9:
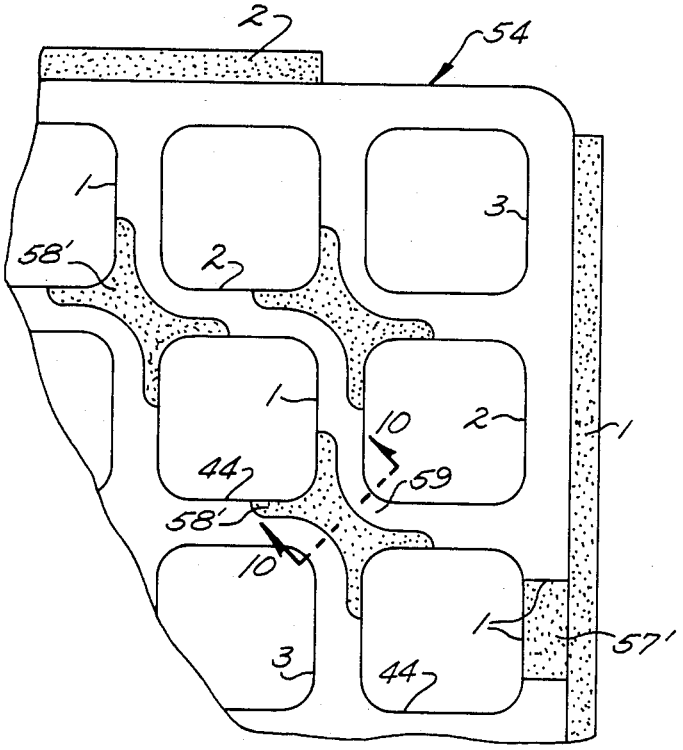
FIG. 9 is an enlarged partial top plan view of the FIG. 8 embodiment.
Figure 10:
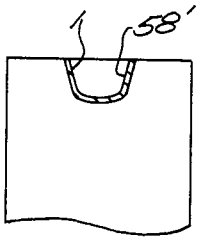
FIG. 10 is a partial cross section taken on lines 10—10 of FIG. 9.

FIGS. 8–10 show a modification of the FIG. 6, 7 embodiment. Heater device 54 is shown to comprise a generally rectangular body having the same type of passages 44 as in the FIG. 6, 7 embodiment along with the conductive coating on the inner walls of the passages 44. However the means for effecting electrical connection to the coatings of each set has been modified to provide improved electrical and thermal balance among the sets. A continuous conductive layer in the form of a stripe is adhered to the outer peripheral wall 56 on two of the four sides for each set so that each set is provided with a generally L-shaped conductive trace with notches 57 formed in each face to provide a conductive trace below the face surface between a stripe on the outer peripheral wall and the outermost passages of the respective set. Thus as seen in FIG. 8 each outer passage of set 1 is connected to strip 1 on outer peripheral wall 56 via notches $57^1$ and each outer passage of set 2 is connected to stripe 2 on wall 56 via notches $57^2$. In like manner, but not shown, outer passages of set 3 are connected to stripe 3 on the bottom face of heater device 54.

The notches formed in the outer face of heater device 54 between adjacent passages of a set have been widened contiguous to the passage to ensure that a low resistance path is obtained even if flash or other irregularities occur in the notch in the vicinity of the passageway. Thus as seen in FIG. 9 notch $58^1$ which has a cross section intermediate its ends as shown in FIG. 10, is widened at each end to encompass a corner portion of respective passages 44 having conductive coating 1 on the walls thereof. The notch is configured such that a selected minimal space 59 is provided between the notch and adjacent passages of other sets to insure effective electrical separation.

Thus in accordance with the invention a multipassage, multiphase, self-regulating fluid heater provides balanced resistive loading among the phases by interspersing the resistance material of the phases among each other throughout the cross section of the heater body.

Figure 11:
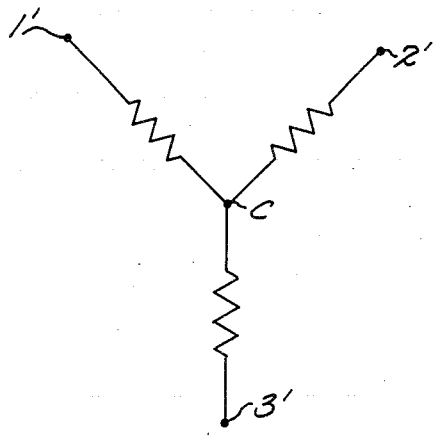
FIG. 11 is a schematic circuit diagram of an embodiment of the invention connected in a wye configuration.
Figure 12:
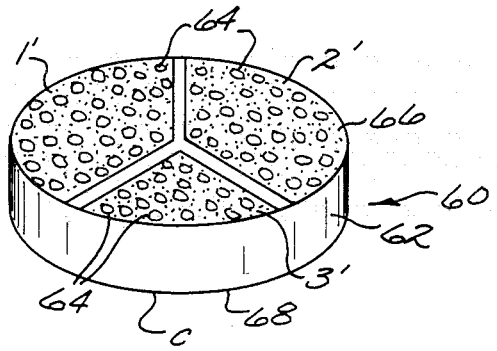
FIG. 12 is a perspective view of the FIG. 11 embodiment.
Figure 13:
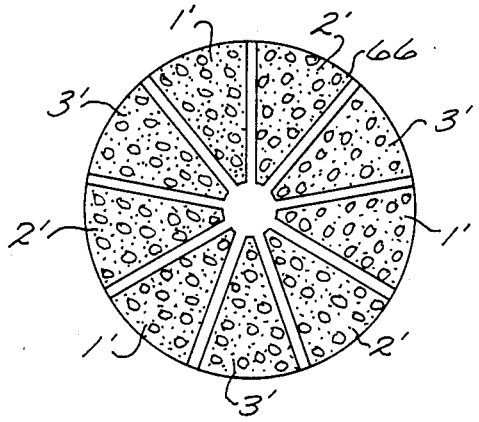
FIGS. 13–15 are top plan views of modifications of the FIG. 12 device.

In FIG. 12 an embodiment is shown which is particularly well suited for electrical connection with a three phase power supply in a wye configuration. A heater device 60 made of a generally circular body 62 of positive temperature coefficient of resistivity ceramic as in the previous embodiments is provided with a plurality of circular passages 64 extending from one end face 66 to an opposite end face 68. Electrically conductive material is adhered to opposite end faces of body 62 with a common layer C on end face 68 and layer portions 1', 2' and 3' (indicated by stippling) adhered to face 66 and separated from one another. Thus each phase current, as indicated in FIG. 11, goes between respective layers 1', 2' and 3' and common layer C through the resistive material of body 62. It will be understood that layers 1', 2' and 3' can be made into smaller portions and alternated across end face 66 as shown in FIG. 13 in order to provide a better thermal loading if the fluid flow through apertures 64 tends to vary across the body.

Figure 14:
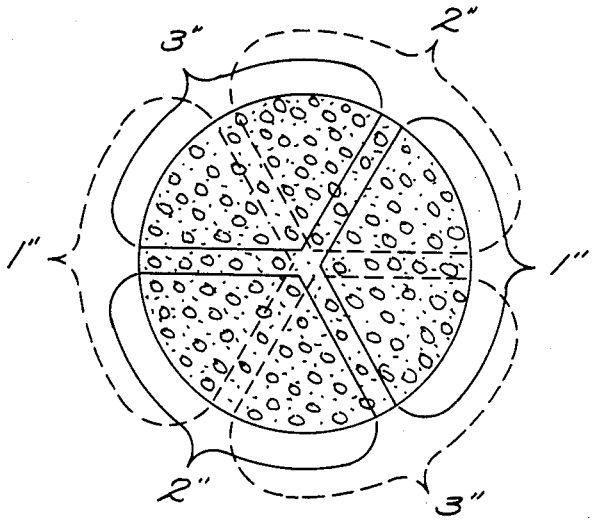
Figure 15:
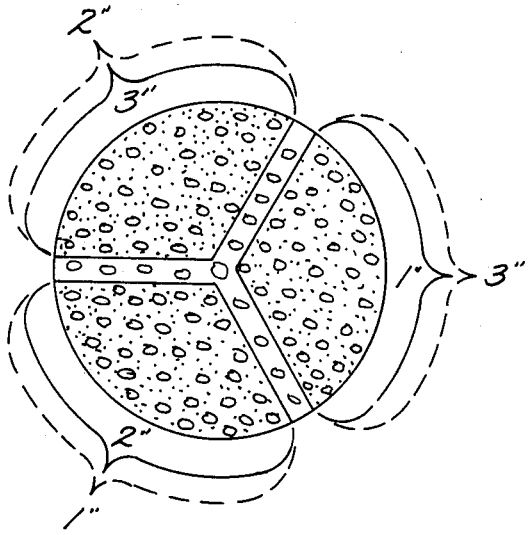

FIGS. 14 and 15 show a three phase resistor heater having conductive coatings on opposite end faces which are adapted for connection in a delta configuration. The conductive contact portions on one face are angularly offset relative to the conductive contact portions on the opposite face to allow current flow among the phases. Preferably the conductive contact portions of a given phase should not overlap the conductive contact portion of the same phase on the opposite face. In FIG. 14 the contact portions are shown offset by an angle of 60°. Thus in FIG. 14 on the top face as shown in the Figure three conductive portions 1", 2" and 3" are adhered thereto but separated from one another while on the bottom face three conductive coatings 1", 2" and 3" are adhered thereto in the same manner but are angularly disposed relative to the coatings on the top face by 60°. Thus when connected in a delta configuration, electrical current will flow between coating portion 1" on the top face and coating portions 2" and 3" on the bottom face; coating portion 2" on the top face and coating portions 3" and 1" on the bottom face;

and coating portion 3 on the top face and coating portions 1 and 2 on the bottom face.

In general it is preferred to construct polyphase resistor heaters of this type as shown in FIG. 15 by providing conductive contact portions equal in number to a multiple of the number of phases by which the resistor device is adapted to be energized, interspersing the portions and adhering them to each end face of the resistor body but angularly offsetting the portions on one face relative to the portions on the other face by three hundred sixty degress divided by the selected number of phases. This results in improved current flow among the phases. As shown in FIG. 15, contact portion 1", 2" and 3" on the top face are angularly aligned with contact potion 3", 1" and 2" respectively on the bottom face.

It should be noted that although a generally circular shaped body 62 and circular passages 64 are shown in FIGS. 12–14 and it is within the purview of the invention to provide other configurations as long as the total resistance for each portion are essentially equal.

Although the passages in the FIGS. 12–14 embodiments have been described as extending side by side between opposite faces, it is within the purview of the invention to form serpentine passages with varying cross sections along their length resulting from making the heater device by sintering bulbs of ceramic material together or by impregnating shape-retaining organic foam materials with a slurry of powder of ceramic material in a fluid carrier and heating the impregnated foam for depositing the powder on the walls of the foam passages, burning off the foam material, and sintering the deposited powder to form the body with serpentine passages as set forth in copending application Ser. No. 780,579, filed Oct. 21, 1985, which issued as U.S. Pat. No. 4,633,069.

It should be understood that although preferred embodiments of the novel and improved resistor of this invention have been described in detail for illustrating the invention, the invention includes all modifications an equivalents of the described embodiment falling within the scope of the appended claims:

What is claimed is:

1. A resistor device comprising a body of resistor material of positive temperature coefficient of resistivity having a plurality of sets of passages extending through the body in spaced side by side relation to each other in a selected pattern defining thin webs of the resistor body material which are of substantially uniform thickness between adjacent passages from end to end of the resistor body, electrically conductive contact means on inner walls of the body passages and electrically conducting interconnecting means disposed on the body electrically connecting the electrically conductive contact means on the inner walls of the passages within each set together, the electrically conducting interconnecting means including at least three portions electrically separated from each other for connection to a power supply, whereby when the electrically conducting interconnecting means are connected in a multiphase circuit, current is directed through thin webs of resistor body material between conductive contact means of one set and conductive contact means of another set in adjacent body passages.

2. A resistor device according to claim 1 in which there are three sets of passages and the passages of the three sets are evenly dispersed relative to one another throughout the body with a passage of one set immediately adjacent only passages of the other sets.

3. A resistor device according to claim 2 wherein the body, in plan view showing one end, is generally hexagonal in configuration.

4. A resistor device according to claim 2 wherein the body, in plan view showing one end, is generally rectangular in configuration.

5. A resistor device according to claim 2 in which the passages are disposed in rows and columns with at least one of the rows and columns having an even multiple of three passages.

6. A resistor device according to claim 1 in which the passages, in plan view showing one end of the body, are generally triangular in configuration.

7. A resistor device according to claim 1 in which the passages, in plan view showing one end of the body, are generally rectangular in configuration.

8. A resistor device according to claim 1 in which the passages, in plan view showing one end of the body, are generally hexagonal in configuration.

9. A resistor device comprising a body of resistor material of positive temperature coefficient of resistivity having three sets of passages extending through the body in spaced side by side relation to each other in a selected pattern defining thin webs of the resistor body material which are of substantially uniform thickness between adjacent passages from end to end of the resistor body, the body having slits located in the webs at ends of the passages so that the respective slits communicate with selected passages, electrically conductive contact means on inner walls of the body passages, and electrically conducting interconnecting means disposed in the slits and on the body electrically connecting the conductive contact means on the inner walls of the passages within each set together while maintaining the sets electrically conducting interconnecting means isolated from each other, whereby when the electrically conducting interconnecting means are connected in a three phase delta configuration circuit, current is directed through thin webs of resistor body material between conductive contact means of one set and conductive contact means of another set in adjacent body passages.

10. A resistor device comprising a body of resistor material of positive temperature coefficient of resistivity having a plurality of passages extending through the body in spaced side by side relation to each other in a selected pattern from a face on one end of the body to a face on an opposite end of the body, electrically conductive contact means on the faces of the body, the electrically conductive contact means on one face being a continuous layer around the passages, the electrically conductive contact means on the other face having at least three electrically separated portions whereby when the conductive contact means are connected in a three phase wye configuration circuit current is directed through the resistor body material between the continuous layer as an electrical common and the respective electrically separated portions.

11. A resistor device according to claim 10 in which the electrically separated portions comprise a plurality of sets of portions, each set comprising three electrically separated portions whereby heat dissipation throughout the body will be more uniform among the three phases with uneven fluid flow through the passages in one part of the body relative to the fluid flow through passages in another part of the body.

12. A resistor device comprising a body of resistor material of positive temperature coefficient of resistivity having a plurality of sets of passages extending through the body in spaced side by side relation to each other in a selected pattern defining webs of the resistor body material between adjacent passages from end to end of the resistor body, electrically conductive contact means on inner walls of the body passages and electrically conducting interconnecting means disposed on the body electrically connecting the conductive contact means on the inner walls of the passages within each set together, the electrically conducting interconnecting means including at least three portions electrically separated from each other for connection to a power supply, whereby when the electrically conducting interconnecting means are connected in a multiphase circuit current is directed through webs of resistor body material between conductive means of one set and conductive contact means of another set in adjacent body passages.

13. A resistor device according to claim 12 in which there are three sets of passages and the passages of the three sets are evenly dispersed relative to one another throughout the body with a passage of one set immediately adjacent only passages of the other sets.

14. A polyphase resistor device comprising a body of resistor material of positive temperature coefficient of resistivity having a plurality of passages extending through the body from a face on one end of the body to a face on an opposite end of the body, electrically conductive contact means on the faces of the body, the electrically conductive contact means on each face having separated portions equal in number to a multiple of the number of phases by which the resistor device is adapted to be energized, the portions on one face being angularly offset relative to the portions on the other face by three hundred sixty degress divided by the said number of phases.

15. A three phase resistor device comprising a body of resistor material of positive temperature coefficient of resistivity having a plurality of passages extending through the body from a face on one end of the body to a face on an opposite end of the body, electrically conductive contact means on the faces of the body, the electrically conductive contact means on each face having three separated portions, the portions on one face being angularly offset relative to the portions on the other face by 120 degrees to facilitate connecting the resistor device in a three phase delta circuit configuration.

16. A polyphase resistor device comprising a body of resistor material of positive temperature coefficient of resistivity having a plurality of passages extending through the body from a face on one end of the body to a face on an opposite end of the body, electrically conductive contact means on the faces of the body, the electrically conductive contact means on each face having separated portions equal in number to a multiple of the number of phases by which the resistor device is adapted to be energized, the portions on one face being angularly offset relative to the portions on the other face.

* * * * *